US010486202B2

(12) United States Patent
Shibata et al.

(10) Patent No.: US 10,486,202 B2
(45) Date of Patent: Nov. 26, 2019

(54) CLEANING DEVICE

(71) Applicant: MITSUBISHI ELECTRIC CORPORATION, Chiyoda-ku, Tokyo (JP)

(72) Inventors: Yohei Shibata, Tokyo (JP); Akio Masuda, Tokyo (JP)

(73) Assignee: MITSUBISHI ELECTRIC CORPORAION, Chiyoda-ku, Tokyo (JP)

( * ) Notice: Subject to any disclaimer, the term of this patent is extended or adjusted under 35 U.S.C. 154(b) by 221 days.

(21) Appl. No.: 15/541,834

(22) PCT Filed: Mar. 10, 2016

(86) PCT No.: PCT/JP2016/057505
§ 371 (c)(1),
(2) Date: Jul. 6, 2017

(87) PCT Pub. No.: WO2016/147995
PCT Pub. Date: Sep. 22, 2016

(65) Prior Publication Data

US 2018/0001355 A1 Jan. 4, 2018

(30) Foreign Application Priority Data

Mar. 19, 2015 (JP) ..... 2015-055562

(51) Int. Cl.
*B08B 3/12* (2006.01)
*C23G 1/24* (2006.01)
(Continued)

(52) U.S. Cl.
CPC ..... *B08B 3/123* (2013.01); *B08B 3/022* (2013.01); *B08B 3/048* (2013.01); *B08B 3/08* (2013.01);
(Continued)

(58) Field of Classification Search
CPC .....
B08B 3/123; B08B 3/22; B08B 3/048; B08B 3/08; B08B 3/10; B08B 3/102;
(Continued)

(56) References Cited

U.S. PATENT DOCUMENTS 8,512,476 B2 8/2013 Kaneko et al.
9,044,794 B2 6/2015 Holsteyns et al.
(Continued)

FOREIGN PATENT DOCUMENTS

JP 08-218190 A 8/1996
JP 2005-342639 A 12/2005
(Continued)

OTHER PUBLICATIONS

JP2010188286A—machine translation (Year: 2010).*
(Continued)

*Primary Examiner* — Michael E Barr
*Assistant Examiner* — Tinsae B Ayalew
(74) *Attorney, Agent, or Firm* — Buchanan Ingersoll & Rooney PC

(57) ABSTRACT

A cleaning device is configured to include a first cleaning tank that holds water to which a small amount of an additive is added as a first cleaning fluid, a second cleaning tank that holds water, a water-based cleaning agent, an alkaline cleaning fluid, or a hydrophilic organic solvent as a second cleaning fluid, a first microscopic air bubble generation device, a first circulating pump, an ultrasonic wave emitting device, and a carrier device. Hydrophobic oil is removed by a cleaning target being exposed to the first cleaning fluid including microscopic air bubbles sprayed from a nozzle in an interior of the first cleaning tank, after which hydrophilic oil is removed by ultrasonic cleaning in the second cleaning tank.

8 Claims, 5 Drawing Sheets

(51) Int. Cl.

| | |
|---|---|
| ***C23G 3/00*** | (2006.01) |
| ***B08B 3/02*** | (2006.01) |
| ***B08B 3/04*** | (2006.01) |
| ***B08B 3/08*** | (2006.01) |
| ***B08B 3/14*** | (2006.01) |
| ***B08B 3/10*** | (2006.01) |

(52) U.S. Cl.
CPC ..... *B08B 3/10* (2013.01); *B08B 3/102* (2013.01); *B08B 3/14* (2013.01); *C23G 1/24* (2013.01); *C23G 3/00* (2013.01); *B08B 2203/007* (2013.01)

(58) Field of Classification Search
CPC ..... B08B 3/14; B08B 2203/007; C23G 1/24; C23G 3/00
USPC ..... 134/61
See application file for complete search history.

(56) References Cited

U.S. PATENT DOCUMENTS

| | | | |
|---|---|---|---|
| 2007/0062555 | A1 | 3/2007 | Chang et al. |
| 2009/0011972 | A1 | 1/2009 | Suzuki et al. |
| 2009/0233828 | A1 | 9/2009 | Suzuki et al. |
| 2016/0228927 | A1 | 8/2016 | Jones |

FOREIGN PATENT DOCUMENTS

| | | | |
|---|---|---|---|
| JP | 2006-206896 | A | 8/2006 |
| JP | 2007-090244 | A | 4/2007 |
| JP | 2010-188286 | A | 9/2010 |
| JP | 2010-227795 | A | 10/2010 |
| JP | 2011-021213 | A | 2/2011 |
| JP | 2011-072980 | A | 4/2011 |
| WO | WO 2010/098263 | A1 | 9/2010 |
| WO | WO 2015/040365 | A1 | 3/2015 |

OTHER PUBLICATIONS

JP2010227795A—machine translation (Year: 2010).*
JP2011072950A—machine translation (Year: 2011).*
WO2010098263A1—machine translation (Year: 2010).*
International Search Report (PCT/ISA/210) dated May 31, 2016, by the Japanese Patent Office as the International Searching Authority for International Application No. PCT/JP2016/057505.
Written Opinion (PCT/ISA/237) dated May 31, 2016, by the Japanese Patent Office as the International Searching Authority for International Application No. PCT/JP2016/057505.
Office Action (Notification of Reasons for Refusal) dated Aug. 1, 2017, by the Japanese Patent Office in corresponding Japanese Patent Application No. 2017-506488 and English translation of the Office Action. (12 pages).
Office Action (Decision of Refusal) dated Jan. 16, 2018, by the Japanese Patent Office in corresponding Japanese Patent Application No. 2017-506488 and English translation of the Office Action. (11 pages).
Chinese Office Action dated Dec. 26, 2018 issued by the Chinese Patent Office in Chinese Patent Application No. 201680006290.8, with English translation (24 pages).
Office Action dated Jul. 10, 2019, by the Chinese Patent Office in corresponding Chinese Patent Application No. 01680006290.8 and English translation of the Office Action. (16 pages).

* cited by examiner

CLEANING DEVICE

TECHNICAL FIELD

The present invention relates to a cleaning device, and in particular, relates to a cleaning device used in decreasing that removes the oil content of machining oil, a lubricant, or the like, adhering to a part surface when processing an industrial part.

BACKGROUND ART

To date, the field of industrial decreasing has mainly been such that solvents such as fluorocarbon-based solvents, organic solvents, and oil-based solvents are used, and degreasing is carried out by causing oil content to be dissolved in these solvents. For example, a cleaning device disclosed in Patent Document 1 is a cleaning device that removes a paste adhering to a mouthpiece, wherein organic solvents such as ketones or alcohols are used as cleaning fluids in two cleaning tanks, one each for a rough clean and a finishing clean.

In Patent Document 1, air bubbles having a diameter of in the region of 1 mm to 10 mm are sprayed into a first cleaning tank with an object of agitating and churning the cleaning fluid, and furthermore, an ultrasonic wave is applied to the cleaning fluids in both the first cleaning tank and a second cleaning tank using ultrasonic wave radiation means installed in bottom portions of the cleaning tanks. By a cleaning target being irradiated with an ultrasonic wave, a cavitation phenomenon occurs on a surface of the cleaning target, and dirt such as oil adhering to the cleaning target is decomposed and detached.

However, there are problems that place a heavy burden on the environment, in that solvents such as fluorocarbon-based solvents, organic solvents, and oil-baaed solvents include substances that cause environmental damage such as destruction of the ozone layer and pollution of rivers, oceans, and groundwater, used cleaning fluid has to be processed as industrial waste when replacing the cleaning fluid, and the like. Because of this, there is a demand for cleaning technology that places little burden on the environment to foe developed to replace cleaning using the aforementioned solvents.

Microbubble cleaning wherein microscopic air bubbles of a diameter of ten micrometers to several tens of micrometers are generated in a cleaning fluid based on water, and caused to act on a cleaning target, is attracting attention as cleaning technology that places little burden on the environment. When the microscopic air bubbles are caused to act on the cleaning target, impurities adhering to the surface of the cleaning target, are adsorbed onto the surfaces of the microscopic air bubbles, and line impurities are removed by the microscopic air bubbles separating from the cleaning target under their own buoyancy. A nonionic surfactant with a specific structure is proposed in Patent Document 2 as a surfactant highly effective in stabilizing desired microscopic air bubbles tor a long time.

CITATION LIST

Patent Literature

Patent Document 1: JP-A-2007-90244
Patent Document 2: JP-A-2006-206896

SUMMARY OF INVENTION

Technical Problem

A method whereby an organic solvent is used as a cleaning fluid, as is the case with the cleaning device presented in Patent Document 1, is such that, in addition to the heretofore described environmental burden problem, there is a problem in that the amount of oil content dissolved in the cleaning fluid increases with each cleaning, and cleaning power decreases, because of which cleaning quality is unstable. Also, as the cleaning fluid needs to be replaced regularly, there is a problem in that maintainability is low.

Meanwhile, microbubble cleaning wherein microscopic air bubbles are caused to act on a cleaning target using a cleaning fluid based on water is such that impurities such as oil content adsorbed onto the surfaces of microscopic air bubbles accumulate on the liquid surface, because of which there is a problem in that the impurities adhere again when the cleaning target is pulled up from the cleaning rank. Because of this, in order to apply microbubble cleaning to a mass production process in the industrial field, a mechanism that does not allow impurities accumulated on the liquid surface to adhere again to the cleaning target is needed, and development of a cleaning device including this kind of mechanism is desired.

The invention, having been contrived in order to resolve the heretofore described kinds of problem, has an object of obtaining a cleaning device such that a burden on the environment is small, maintainability is excellent, and a high cleaning power can be stably maintained for a long period.

Solution to Problem

A cleaning device according to the claims of the invention includes a first cleaning tank that holds a first cleaning fluid, a first microscopic air bubble generation device that generates microscopic air bubbles in the first cleaning fluid, a first circulating pump that causes the first cleaning fluid to circulate and supplies the first cleaning fluid including microscopic air bubbles to the first cleaning tank, a second cleaning tank that holds a second cleaning fluid, an ultrasonic wave emitting device that irradiates an interior of the second cleaning tank with an ultrasonic wave, and a carrier device that holds a cleaning target, conveys the cleaning target to the first cleaning tank, and subsequently continues by conveying the cleaning target to the second cleaning tank, wherein water to which an additive that prevents air bubble coalescence is added is used as the first cleaning fluid, one of water, a water-based cleaning agent, an alkaline cleaning fluid, or a hydrophilic organic solvent is used as the second cleaning fluid, the first cleaning tank has a nozzle that sprays the first cleaning fluid above a surface of the first cleaning fluid in an interior of the first cleaning tank, and the carrier device conveys the cleaning target into the interior of the first cleaning tank, and causes the cleaning target to pass through a region in which the first cleaning fluid is sprayed from the nozzle.

Also, a cleaning device according to the claims of the invention includes a first cleaning tank that holds a first cleaning fluid, a first microscopic air bubble generation device that generates microscopic air bubbles in the first cleaning fluid, a first circulating pump that causes the first cleaning fluid to circulate and supplies the first cleaning fluid including microscopic air bubbles to the first cleaning tank, a second cleaning tank that holds a second cleaning fluid, an ultrasonic wave emitting device that irradiates an interior of the second cleaning tank with an ultrasonic wave, and a carrier device that holds a cleaning target, conveys the cleaning target to the first cleaning tank, and subsequently continues by conveying the cleaning target to the second cleaning tank, wherein water to which an additive that prevents air bubble coalescence is added is used as the first cleaning fluid, one of water, a water-bases cleaning agent, an alkaline cleaning fluid, or a hydrophilic organic solvent is used as the second cleaning fluid, the first cleaning tank has a partitioning plate that divides a surface of the first cleaning fluid held in an interior of the first cleaning tank into two regions, those being a cleaning target introduction region into which the cleaning target is introduced and a cleaning target removal region from which the cleaning target is removed, the partitioning plate is installed leaving a gap with a bottom portion of the first cleaning tank through which the cleaning target can pass, the first circulating pump supplies the first cleaning fluid including microscopic air bubbles to the first cleaning tank, and the carrier device introduces the cleaning target from the cleaning target introduction region of the first cleaning tank, causes the cleaning target to pass below the partitioning plate, and removes the cleaning target from the cleaning target removal region.

Advantageous Effects of Invention

According to the cleaning devices according to the claims of the invention, wafer to which an additive has been added is used as a first cleaning fluid in a first cleaning tank, into which the greatest amount of oil content from a cleaning target is brought, and by a degreasing using microscopic air bubbles being implemented, hydrophobic oil removed from the cleaning target can be caused to accumulate on a surface without being dissolved in the first cleaning fluid. Because of this, the oil content can be collected separately from the first cleaning fluid, whereby the maintenance frequency of the first cleaning tank can be considerably reduced. Also, as there is hardly any deterioration of the first cleaning fluid itself, there is no decrease in cleaning power in accordance with an increase in the number of cleanings, and a stable cleaning quality can be secured for a long period. Furthermore, it is possible for only collected oil to be processed as industrial waste, and even when the first cleaning fluid is processed as industrial waste, the first cleaning fluid replacement frequency is low, because of which the amount of waste fluid is also low, and there is little burden on the environment.

Also, according to the cleaning device according to the claims of the invention, the first cleaning fluid is sprayed from a nozzle in the first cleaning tank, and the cleaning target is not immersed in the first cleaning fluid, because of which hydrophobic oil accumulated on the surface of the first cleaning fluid can be prevented from adhering again to the cleaning target.

Also, according to the cleaning device according to the claims of the invention, microscopic air bubbles are caused to act on the cleaning target in fluid in a cleaning target introduction region of the first cleaning tank, because of which hydrophobic oil separated off by the microscopic air bubbles is accumulated mainly on a surface in the cleaning target introduction region, and a surface in a cleaning target removal region can be maintained in a purified state. Because of this, the hydrophobic oil can be prevented from adhering again when the cleaning target is removed from the first cleaning fluid.

Objects, characteristics, aspects, and advantages of the invention other than those heretofore described will be further clarified by the following detailed description of the invention, with reference to the drawings.

DESCRIPTION OF EMBODIMENTS

First Embodiment

Figure 1:
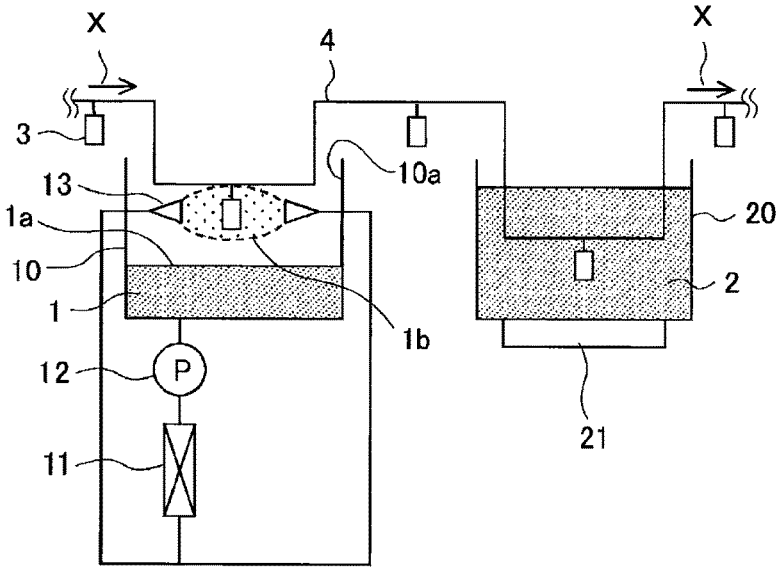
FIG. 1 is a schematic view showing a cleaning device according to a first embodiment of the invention.

Hereafter, based on the drawings, a cleaning device according to a first embodiment of the invention will be described. FIG. 1 shows an overall configuration of the cleaning device according to the first embodiment. The cleaning device according to the first embodiment is a cleaning device used in degreasing that removes the oil content of machining oil, a lubricant, or the like, adhering to a surface of an industrial part, and includes a first cleaning tank 10, a second cleaning tank 20, a first microscopic air bubble generation device 11, a first circulating pump 12, an ultrasonic wave emitting device 21, a carrier device 4, and cleaning fluid temperature raising means (omitted from the drawings).

A first cleaning fluid 1 primarily for removing hydrophobic oil is held in the first cleaning tank 10, and a second cleaning fluid 2 primarily for removing hydrophilic (water-soluble) oil is held in the second cleaning tank 20. In the first embodiment, water to which is added an additive that prevents air bubble coalescence is used as the first cleaning fluid 1. Also, any of water, a water-based cleaning agent, an alkaline cleaning fluid, or a hydrophilic (polarity) organic solvent can be used as the second cleaning fluid 2, with water being used in the first embodiment. These cleaning fluids will later be described in detail.

The first microscopic air bubble generation device 11 generates microscopic air bubbles of a diameter of ten micrometers to several tens of micrometers in the first cleaning fluid 1. Hydrophobic oil adhering to a cleaning target 3 is removed by an action of the microscopic air bubbles in the first cleaning tank 10. A principle of decreasing using microscopic air babbles will be described later.

The first circulating pump 12 causes the first cleaning fluid 1 to circulate, thereby supplying the first cleaning fluid 1 including the microscopic air bubbles to the first cleaning tank 10. In the first embodiment, the first cleaning tank 10 has a multiple of nozzles 13 that spray the first cleaning fluid 1 into an interior of the first cleaning tank 10. The first circulating pump 12 supplies the first cleaning fluid 1 including the microscopic air bubbles, whose temperature has been raised by the temperature raising means, to the nozzles 13. Installation positions and spraying regions of the nozzles 13 are determined so that the nozzles 13 are above a surface 1*a* of the first cleaning fluid 1, and the first cleaning fluid 1 sprayed from the nozzles 13 hits an inner wall 10*a* of the first cleaning tank 10 and is collected, without scattering into the periphery.

A pipe connected to a vicinity of a bottom portion of the first cleaning tank 10 is connected to the first circulating pump 12, and furthermore, connected to the nozzles 13 via the first microscopic air bubble generation device 11. That is, the first microscopic air bubble generation device 11 is provided between the first circulating pump 12 and nozzles 13, and is of a configuration that generates microscopic air bubbles in the first cleaning fluid 1 partway along a pipe path.

The ultrasonic wave emitting device 21 installed in a bottom portion of the second cleaning tank 20 irradiates an interior of the second cleaning tank 20 with an ultrasonic wave, and the cleaning target 3 is irradiated with the ultrasonic wave via the second cleaning fluid 2. The frequency of the ultrasonic wave emitted by the ultrasonic wave emitting device 21 is in a range of 10 Hz to 1 MHz, which can cause a cavitation phenomenon to occur, and when the cleaning device according to the first embodiment is applied to an industrial field, a range of 100 Hz to 1 MHz is preferable in terms of cleaning process speed, and a range of 1 kHz to 1 MHz more preferable still.

The carrier device 4 holds the cleaning target 3 and conveys the cleaning target 3 to the first cleaning tank 10, after which the carrier device 4 continues by conveying the cleaning target 3 to the second cleaning tank 20. In FIG. 1, an arrow X indicates a conveying direction of the carrier device 4. In the first embodiment, the carrier device 4 conveys the cleaning target 3 into the inferior of the first cleaning tank 10, and causes the cleaning target 3 to pass through a spraying region 1*b* over which the first cleaning fluid 1 is being sprayed from the nozzles 13. Continuing, the carrier device 4 moves the cleaning target 3 to the second cleaning tank 20, immerses the cleaning target 3 in the second cleaning fluid 2 being irradiated with the ultrasonic wave, then removes the cleaning target 3 from the second cleaning fluid 2.

Next, the cleaning fluids will be described. Water to which a small amount of an additive has been added is used as the first cleaning fluid 1 held in the first cleaning tank 10. The additive is a substance having a function of preventing microscopic air bubbles generated by the first microscopic air bubble generation device 11 from coalescing, thereby allowing the microscopic air bubbles to exist stably in the water for a long time. Specifically, a substance such as a (poly) oxyalkylene adduct of an active hydrogen atom-containing compound, shown in a following Expression 1 disclosed in Patent Document 2, can be used.

$$Z\text{-}[(AO)_n\text{—}H]_p \qquad \text{(Expression 1)}$$

In Expression 1, Z is a residue when active hydrogen is removed from a p-valent active hydrogen atom-containing compound, A is a 1-8C alkylene group, n is an integer between 1 and 400, and p is an integer between 1 and 100.

Also, a concentration of the additive is preferably in a range of 10 ppm to 10,000 ppm. Furthermore, when the cleaning device according to the first embodiment is applied to an industrial field, it is more preferable in terms of operating cost and cleaning quality that the concentration of the additive is in a range of 100 ppm to 1,000 ppm. When the additive concentration is too high, the amount of additive lost due to cleaning fluid evaporation, removal by the cleaning target 3, and the like, increases, and costs incurred for the cleaning fluids increase. Meanwhile, when the additive concentration is too low, the effect of preventing air bubble coalescence is not sufficiently realized, air bubble coalescence occurs partway along the pipe from the first microscopic air bubble generation device 11 to the nozzles 13, and the size of air bubbles acting on the cleaning target 3 increases.

A cleaning method whereby the oil content is removed by being adsorbed onto surfaces of the microscopic air bubbles is such that the cleaning process speed depends on the air bubble surface area, because of which the air bubble surface area decreases when the air bubble size increases, and the cleaning process speed decreases. When the cleaning device according to the first embodiment is applied to a mass production process in the industrial field, a cleaning speed synchronous with a cycle time of processes before and after the cleaning process is required, because of which a decrease in the cleaning process speed is undesirable. For these reasons, it is preferable in terms of cleaning cost and cleaning process speed that the additive concentration is set in the heretofore described range.

Also, as the second cleaning fluid 2 held in the second cleaning tank 20, it is necessary to select a cleaning fluid into which the cleaning target 3 bringing the first cleaning fluid 1 is not a problem, with water being used in the first embodiment. Oil that is a target of decreasing in the second cleaning tank 20 is mainly hydrophilic (water-soluble) oil, because of which a sufficient degreasing effect is obtained by using water as the second cleaning fluid 2.

When still greater cleaning power is required of the second cleaning fluid 2, a water-based cleaning agent, an alkaline cleaning fluid, a hydrophilic (polarity) organic solvent, or the like, is used. By these being used, decreasing of not only water-soluble oil bat also hydrophobic oil can be carried out in the second cleaning tank 20, because of which, even in a case wherein hydrophobic oil cannot be sufficiently removed in the first cleaning tank 10 due to some sudden problem, the hydrophobic oil can fee removed in the second cleaning tank 20, whereby the cleaning quality can be secured at a higher level.

Furthermore, the cleaning device according to the first embodiment can be applied to an iron-based part by a small amount of a rust-preventive agent being added to either or both of the first cleaning fluid 1 and second cleaning fluid 2. In the first cleaning tank 10 in particular, as microscopic air bubbles are introduced into the first cleaning fluid 1, the concentration of dissolved oxygen in the first cleaning fluid 1 is high, and a corrosion reaction is liable to advance in the cleaning target 3 during the cleaning process. Therefore, by a rust-preventive agent being added to the first cleaning fluid 1, the cleaning process can be carried out while restricting the corrosion reaction. The amount of rust-preventive agent added is determined in accordance with the kind of rust-preventive agent. For example, when using a Magnus (registered trademark) made by Parker Corporation Co., Ltd., anti-rusting can be provided by an addition of approximately 0.1 w %.

A flow of a cleaning process in which the cleaning device according to the first embodiment is used will be described in detail using FIG. 1. The cleaning target 3 is held by the carrier device 4 so as not to fall, and introduced into the interior of the first cleaning tank 10. The nozzles 13 are installed in the interior of the first cleaning tank 10 so as not to interfere in the direct ion in which the cleaning target 3 is conveyed. While the cleaning target 3 is being conveyed in a horizontal direction above the surface 1*a* of the first cleaning fluid 1, the cleaning target 3 is exposed to the first cleaning fluid 1, including microscopic air bubbles, sprayed from the nozzles 13. In order to increase the degreasing effect, the temperature of the first cleaning fluid 1 is raised by the temperature raising means.

A description will be given of the principle of degreasing using microscopic air bubbles. As a hydrophobic oil has low polarity, the hydrophobic oil exists in an unstable state in water, which has high polarity, without being solvated from the water, which is a solvent. Because of this, when causing hydrophobic air bubbles to act in water, the hydrophobic oil is adsorbed onto the surfaces of the more stable air bubbles. The air bubbles onto whose surfaces the hydrophobic oil is adsorbed are collected in the first cleaning tank 10 together with the first cleaning fluid 1. The air bubbles collected in the first cleaning tank 10 float in the first cleaning fluid 1 under their own buoyancy, and burst on reaching the surface 1*a*. As a result of this, the hydrophobic oil accumulates on the surface 1*a* of the first cleaning tank 10. When hydrophobic oil and water-soluble oil are adhering to the cleaning target 3, removal of the hydrophobic oil predominates in the first cleaning tank 10.

On finishing the degreasing by the microscopic air bubbles in the first cleaning tank 10, the cleaning target 3 is moved to a position above the second cleaning tank 20 by the carrier device 4, and lowered to a position completely immersed in the second cleaning fluid 2 held in the second cleaning tank 20. An ultrasonic wave is applied by the ultrasonic wave emitting device 21 to the second cleaning fluid 2 held in the second cleaning tank 20, and by the cleaning target 3 being immersed for a predetermined time in the second cleaning fluid 2, water-soluble oil adhering to the surface of the cleaning target 3 is dissolved in the second cleaning fluid 2. The cleaning target 3 is conveyed in a horizontal direction in the second cleaning tank 20 in a state completely immersed in the second cleaning fluid 2, after which the cleaning target 3 is removed from the second cleaning fluid 2.

A description will be given of advantages of one cleaning device according to the first embodiment in comparison with an existing degreasing device. The existing device, wherein oil content adhering to a cleaning target is dissolved in a solvent such as an organic solvent, is such that the removed oil content accumulates in the cleaning fluid. An industrial-use decreasing device is such that, normally, a multiple of cleaning tanks are used, but as there is considerable deterioration of cleaning fluid in a first cleaning tank, into which the greatest amount of oil content from the cleaning target is brought, the frequency of maintenance such as cleaning fluid concentration adjustment and replacement is determined by the first cleaning tank.

Also, a cleaning method whereby oil content is dissolved in a cleaning fluid is such that when the amount of oil content accumulated in the cleaning fluid increases, the dissolving power of the cleaning fluid with respect to oil decreases. Because of this, maintenance whereby cleaning fluid is added or replaced needs to be implemented regularly, but there is a difference in cleaning power between new fluid and cleaning fluid immediately before maintenance, and a part cleaned with cleaning fluid immediately before maintenance is of inferior cleaning quality compared with a part cleaned with new fluid. Also, the existing cleaning device is such that as the cleaning fluid in the first cleaning tank deteriorates quickly, maintenance needs to be implemented frequently, which expressed in another way means that the frequency of washing with cleaning fluid immediately before maintenance is high, which is a factor in reducing cleaning quality.

Furthermore, the existing device is such that an organic solvent or the like is used as the cleaning fluid, because of which used cleaning fluid needs to be processed as industrial waste when replacing the cleaning fluid. Also, even when using a cleaning fluid that places little burden on the environment, such as a water-based cleaning agent, a large amount of oil content is dissolved in the used cleaning fluid, because of which the cleaning fluid still needs to be disposed of as industrial waste.

Meanwhile, the cleaning device according to the first embodiment is such that water to which an additive has been added is used as the first cleaning fluid 1 in the first cleaning tank 10, into which the greatest amount of oil content from the cleaning target 3 is brought, and by a degreasing using microscopic air bubbles being implemented, hydrophobic oil removed from the cleaning target 3 can be caused to accumulate on the surface 1*a* without being dissolved in the first cleaning fluid 1, and can be collected separately from the first cleaning fluid 1. As a result of this, the maintenance frequency of the first cleaning tank 10 can be considerably reduced, and a long maintenance-free period can be realized as the cleaning process.

Also, as a spraying method whereby the first cleaning fluid 1 is sprayed from the nozzles 13 is employed in the first cleaning tank 10, the cleaning target 3 is not immersed in the first cleaning fluid 1, because of which hydrophobic oil floating on the surface 1*a* of the first cleaning fluid 1 does not adhere again to the cleaning target 3. Also, as there is hardly any deterioration of the first cleaning fluid 1 itself held in the first cleaning tank 10, there is no decrease in cleaning power in accordance with an increase in the number of cleanings, and a stable cleaning quality can be secured.

Furthermore, as oil content accumulated on the surface 1*a* of the first cleaning fluid 1 can be collected separately, it is sufficient that only collected oil is processed as industrial waste when implementing maintenance. Alternatively, even when considering the possibility of an environment-polluting substance mixing with the first cleaning fluid 1 during the cleaning process and adopting a management form such that the first cleaning fluid 1 is processed as industrial waste, maintenance frequency is extremely low compared with the existing device, because of which the frequency with which used first cleaning fluid 1 is generated is low. According to the first embodiment, as heretofore described, a cleaning device such that a burden on the environment is small, maintainability is excellent, and a high cleaning power can be stably maintained for a long period, is obtained.

Second Embodiment

Figure 2:
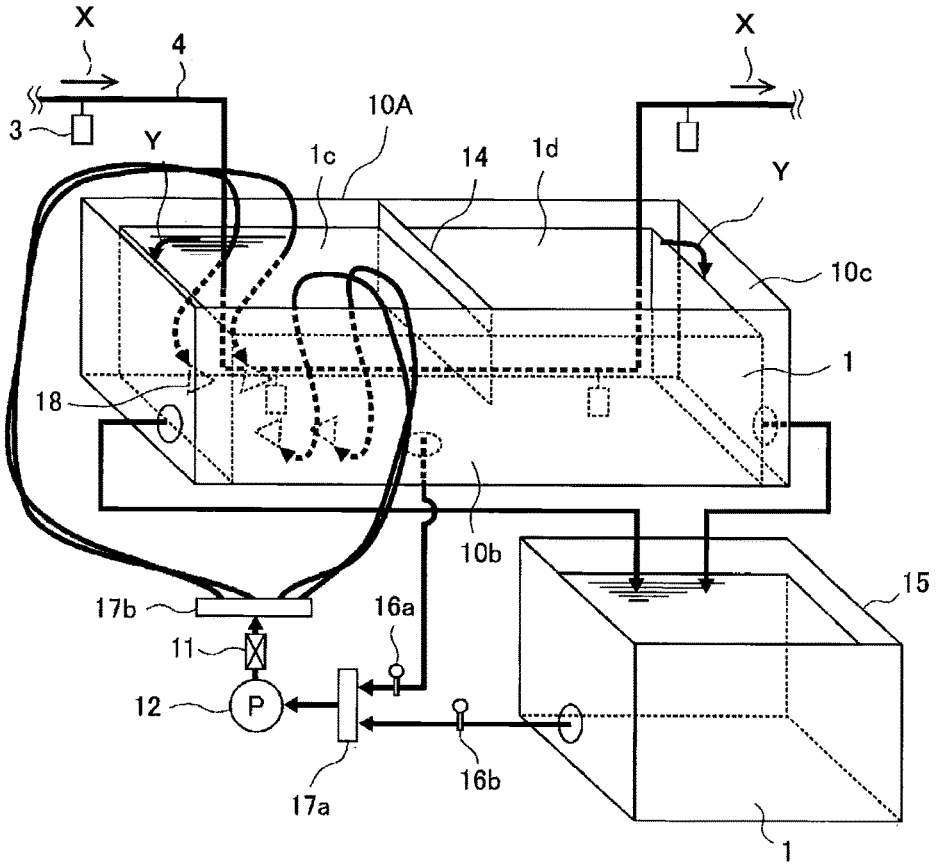
FIG. 2 is a perspective view showing a configuration of a first cleaning tank periphery in a cleaning device according to a second embodiment of the invention.

FIG. 2 shows a configuration of a first cleaning tank periphery in a cleaning device according to a second embodiment of the invention. In FIG. 2, the same reference signs are assigned to portions identical to or corresponding to portions in FIG. 1, and a description thereof is omitted. Also, as the configuration of the second cleaning tank 20 in the cleaning device according to the second embodiment is the same as in the first embodiment, an illustration and description thereof are omitted. In the second embodiment too, the same first cleaning fluid 1 and second cleaning fluid 2 as in the first embodiment are used.

In the first embodiment, a spraying method whereby the first cleaning fluid 1 is sprayed from the nozzles 13 is employed in the first cleaning tank 10, but in the second embodiment, a cleaning aspect such that microscopic air bubbles are sprayed in a state wherein the cleaning target 3 is immersed in the first cleaning fluid 1 is employed in a first cleaning tank 10A. Cleaning power when degreasing depends on the oil temperature of the degreasing target, so the higher the temperature, the greater the cleaning power obtained. Because of this, the cleaning device according to the first embodiment is also such that the first cleaning fluid 1 whose temperature has been raised is supplied to the nozzles 13.

However, when the cleaning target 3 is large, or when the temperature of the cleaning target 3 is low in winter, it may happen that the temperature of oil adhering to the surface of the cleaning target 3 during the cleaning process does not rise as far as a setting temperature of the first cleaning fluid 1, and a sufficient cleaning effect is not obtained. In particular, as the spraying method is such that an area of the first cleaning fluid 1 in contact with the air is large and liable to radiate heat, the temperature of the first cleaning fluid 1 has to be set high in comparison with the immersion method.

In the second embodiment, by immersing the cleaning target 3 in the first cleaning fluid 1 in the first cleaning tank 10A, thereby ensuring that the cleaning target 3 is in contact with the first cleaning fluid 1 for a long time, the effect of raising the temperature of the cleaning target 3 can be increased, and neat radiation from the first cleaning fluid 1 can be restricted further compared with the spraying method. Consequently, the setting temperature of the first cleaning fluid 1 can be set lower than in the first embodiment.

As shown in FIG. 2, the first cleaning tank 10A in the second embodiment has a partitioning plate 14 that divides a surface of the first cleaning fluid 1 held in an interior of the first cleaning tank 10A into two regions, those being a cleaning target introduction region 1*c* into which the cleaning target 3 is introduced, and a cleaning target removal region 1*d* from which the cleaning target 3 is removed. The partitioning plate 14 is installed leaving a gap with a bottom portion 10*b* of the first cleaning tank 10A through which the cleaning target 3 can pass.

In the second embodiment, the first cleaning fluid 1 including microscopic air bubbles is supplied from a discharge port 18 of the cleaning target introduction region 1*c* of the first cleaning tank 10A in the vicinity of the bottom portion 10*b*. The carrier device 4 holds the cleaning target 3 and conveys the cleaning target 3 to the first cleaning tank 10A, after which the carrier device 4 continues by conveying the cleaning target 3 to the second cleaning tank 20. In FIG. 2, an arrow X indicates a conveying direction or the carrier device 4. In the second embodiment, the carrier device 4 introduces the cleaning target 3 from the cleaning target introduction region 1*c* of the first cleaning tank 10A, causes the cleaning target 3 to pass below the partitioning plate 14, and removes the cleaning target from the cleaning target removal region 1*d*.

Figure 3:
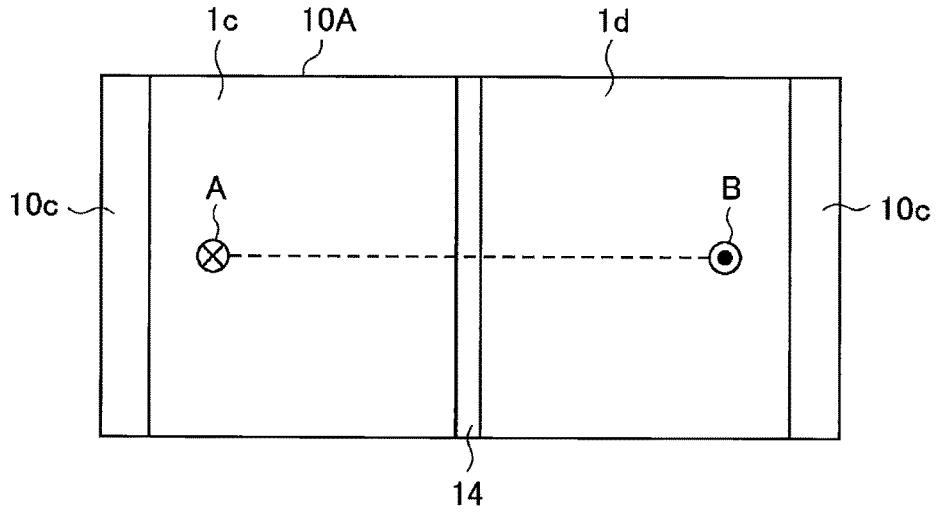
FIG. 3 is a top view showing the first cleaning tank in the cleaning device according to the second embodiment of the invention.
Figure 4:
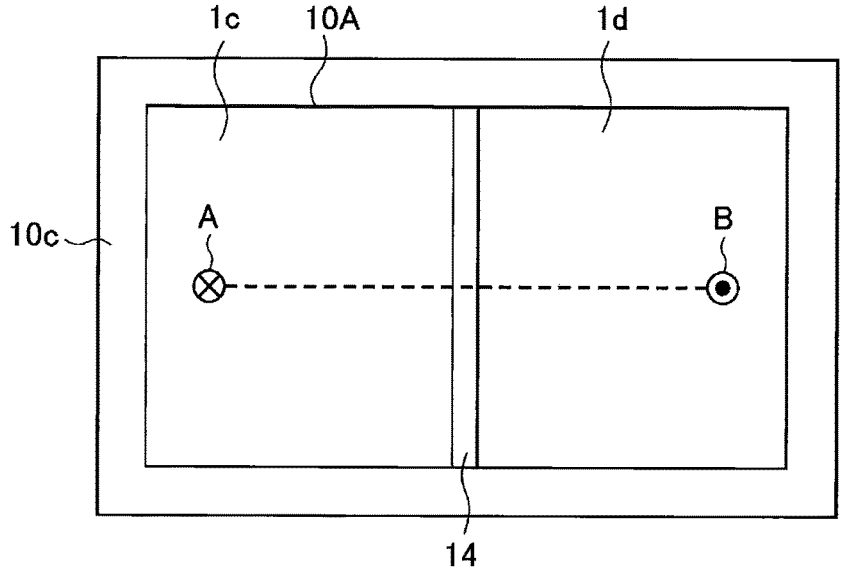
FIG. 4 is a top view showing another example of the first cleaning tank in the cleaning device according to the second embodiment of the invention.

Also, the cleaning device according to the second embodiment includes a first collecting groove 10*c* that collects the first cleaning fluid 1 caused to overflow from a wall face of at least one portion of the first cleaning tank 10A, and a first collecting tank 15 that holds the first cleaning fluid 1 collected by the first collecting groove 10*c*. In FIG. 2, an arrow Y indicates an overflow direction. FIG. 3 is a top view showing the first cleaning tank 10A shown in FIG. 2, wherein the first cleaning fluid 1 is caused to overflow from two wall faces opposed across the partitioning plate 14. Also, FIG. 4 is a top view showing another example of the first cleaning tank 10A in the cleaning device according to the second embodiment. As shown in FIG. 4, the first cleaning fluid 1 may be caused to overflow from all wall faces.

In FIG. 3 and FIG. 4, A indicates a position in which the cleaning target 3 is introduced into the first cleaning fluid 1, and B indicates a position from which the cleaning target 3 is removed from the first cleaning fluid 1. A structure such that the first collecting groove 10*c* is provided in each of the cleaning target introduction region 1*c* and cleaning target removal region 1*d* is preferable. Overflow from two opposing wall faces is advantageous in terms of reducing the installation space of the first cleaning tank 10A, while an overall overflow is advantageous in terms of a collection rate of hydrophilic oil floating to the surface. In the second embodiment, the first cleaning fluid 1 caused to overflow from the first cleaning tank 10A is collected in the first collecting tank 15 via the first collecting groove 10*c*, but the first cleaning fluid 1 need not necessarily pass through the first collecting groove 10*c*.

Also, in the second embodiment, a pipe connected to the bottom portion 10*b* of the first cleaning tank 10A and a pipe connected to a vicinity of a bottom portion of the first collecting tank 15 are connected via a manifold 17*a* to the first circulating pump 12, as shown in FIG. 2. A discharge side of the first circulating pump 12 is connected via a manifold 17*b* to the discharge port 18 of the cleaning target introduction region 1*c* of the first cleaning tank 10A in the vicinity of the bottom portion 10*b*. The first microscopic air babble generation device 11 is connected between the first circulating pump 12 and discharge port 18, and the first cleaning fluid 1 including microscopic air bubbles is supplied to the discharge port 13.

The amount of the first cleaning fluid 1 supplied to the first microscopic air bubble generation device 11 from the first cleaning sank 10A is regulated by a flow regulator 16*a*, which is a first supply regulation unit. In the same way, the amount of the first cleaning fluid 1 supplied to the first microscopic air bubble generation device 11 from the first collecting tank 15 is regulated by a flow regulator 16*b*, which is a second supply regulation unit. According to the heretofore described configuration, the first circulating pump 12 can supply the first cleaning fluid 1 held in the first cleaning tank 10A and the first cleaning fluid 1 held in the first collecting tank 15 to the first cleaning tank 10A via the first microscopic air bubble generation device 11. Also, the amount of overflow from the first cleaning tank 10A can be regulated by the flow regulators 16*a* and 16*b*, and when there is excessive foaming at a time of overflow, the foaming can be restricted by reducing the amount of overflow.

A flow of a cleaning process in the first cleaning tank 10A of the cleaning device according to the second embodiment will be described. The cleaning target 3 is introduced by the carrier device 4 from the cleaning target introduction region 1*c* of the first cleaning tank 10A, and immersed in the first cleaning fluid 1. The cleaning target 3 is exposed to the first cleaning fluid 1 including microscopic air bubbles while being conveyed in a horizontal direction through a region in which a multiple of the discharge port 18 are disposed in the first cleaning fluid 1, whereby the oil content adhering to the surface is removed. Subsequent to this too, the cleaning target 3 is conveyed in the horizontal direction, passes below the partitioning plate 14, enters the cleaning target removal region 1*d*, and is removed from the first cleaning fluid 1 from a predetermined position.

A description will be given of behavior of oil content separated from the cleaning target 3 by microscopic air bubbles in the first cleaning tank 10A. Microscopic air bubbles to whose surfaces hydrophobic oil has been caused to adsorb are separated from the cleaning target 3 under their own buoyancy, and float in the first cleaning fluid 1. The microscopic air bubbles, which move in a vertically upward direction in the first cleaning fluid 1, burst on reaching the surface, and only the hydrophobic oil remains on the surface. The surface is divided into two portions by the partitioning plate 14, and the hydrophobic oil separated off by the microscopic air bubbles floats mainly in the cleaning target introduction region 1*c*.

As the first cleaning tank 10A has mechanisms that cause the first cleaning fluid 1 to overflow, hydrophobic oil floating to the surface is collected in the first collecting tank 15 via the first collecting groove 10*c*, which is provided in each of the cleaning target introduction region 1*c* and cleaning target removal region 1*d*. Owing to these mechanisms, the surface of the first cleaning fluid 1, particularly in the cleaning target removal region 1*d*, can be constantly maintained in a purified state, and the hydrophobic oil can be prevented from adhering again when the cleaning target 3 is removed from the first cleaning fluid 1.

According to the cleaning device according to the second embodiment, the cleaning target 3 is immersed in the first cleaning fluid 1 in the first cleaning tank 10A, because of which, in addition to the same advantages as in the first embodiment, the effect of raising the temperature of the cleaning target 3 increases, a still greater cleaning effect is obtained, and the setting temperature of the first cleaning fluid 1 can be reduced, because of which a reduction in cost is achieved.

Third Embodiment

Figure 5:
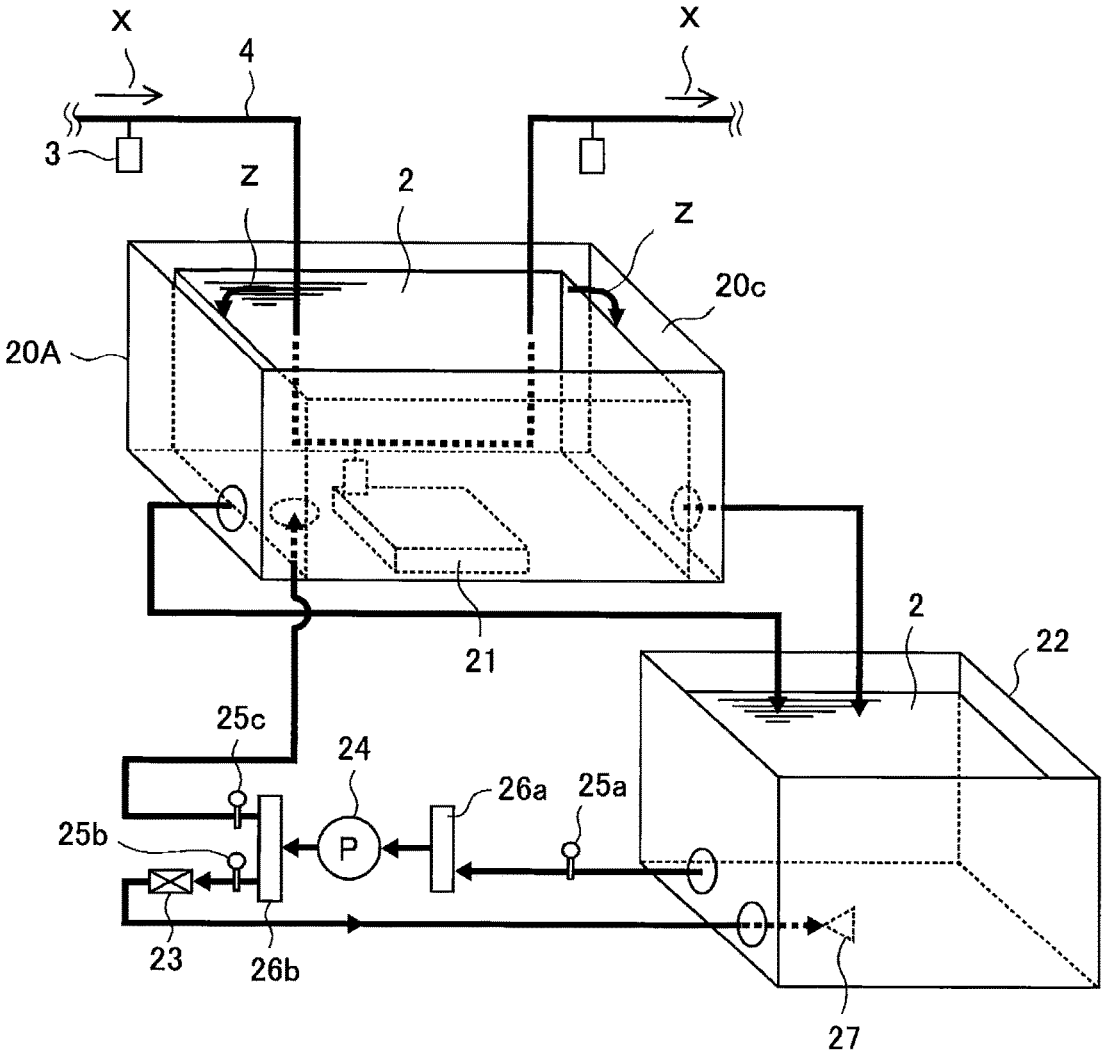
FIG. 5 is a perspective view showing a configuration of a second cleaning tank periphery in a cleaning device according to a third embodiment of the invention.

FIG. 5 shows a configuration of a second cleaning tank periphery in a cleaning device according to a third embodiment of the invention. In FIG. 5, the same reference signs are assigned to portions identical to or corresponding to portions in FIG. 1, and a description thereof is omitted. Also, either the first cleaning tank 10 of the first embodiment (refer to FIG. 1) or first cleaning tank 10A of the second embodiment (refer to FIG. 2) may be employed as a configuration of the first cleaning tank in the third embodiment. In the third embodiment too, the same first clearing fluid 1 and second cleaning fluid 2 as in the first embodiment are used.

A second cleaning tank 20A in the cleaning device according to the third embodiment includes a mechanism such that the second cleaning fluid 2 is purified by water-soluble oil dissolved in the second cleaning fluid 2 being separated. As shown in FIG. 5, the second cleaning tank 20A includes a second collecting groove 20*c* that collects the second cleaning fluid 2 caused to overflow from a wall face of at least one portion, and a second collecting tank 22 that holds the second cleaning fluid 2 collected by the second collecting groove 20*c*, and further includes a second microscopic air bubble generation device 23 that generates microscopic air bubbles of a diameter of ten micrometers to several tens of micrometers in the second cleaning fluid 2, and a second circulating pump 24 that causes the second cleaning fluid 2 to circulate. In FIG. 5, an arrow Z indicates an overflow direction.

The second circulating pump 24 supplies the second cleaning fluid 2 held in the second collecting tank 22 to the second cleaning tank 20A, and returns the second cleaning fluid 2 held in the second collecting tank 22 to the second collecting tank 22 via the second microscopic air bubble generation device 23. The second collecting tank 22 and second circulating pump 24 are connected via a flow regulator 25*a* and manifold 26*a*, and the amount of the second cleaning fluid 2 supplied to the second circulating pump 24 is regulated by the flow regulator 25*a*. Also, a discharge side of the second circulating pump 24 is divided by a manifold 26*b*, wherein the second cleaning fluid 2 in one branch is supplied via a flow regulator 25*b* and the second microscopic air bubble generation device 23 to the second collecting tank 22, while the second cleaning fluid 2 in the other branch is supplied via a flow regulator 25*c* to the second cleaning tank 20A.

A main degreasing target oil of the second cleaning tank 20A is a water-soluble oil that is difficult to remove in the first cleaning tank 10 (or 10A). In the second cleaning tank 20A, cleaning is carried out by water-soluble oil adhering to the cleaning target 3 being dissolved in water, which is the second cleaning fluid 2, because of which the water-soluble oil accumulates in the second cleaning fluid 2 in accordance with an increase in the number of cleanings. In the third embodiment, the water-soluble oil accumulated in the second cleaning fluid 2 is separated using microscopic air bubbles, whereby the second cleaning fluid 2 is purified.

The reason the second cleaning fluid 2 is purified using microscopic air bubbles will be explained. A large number of water-soluble oils include a surfactant component, and by oil content that is originally hydrophobic being covered in the surfactant component, the oil content disperses in a stabilized state in the second cleaning fluid 2. When microscopic air bubbles are supplied to the second cleaning fluid 2 in this kind of state, the surfactant component changes to an insoluble metal soap and separates, because of which the oil content becomes unable to exist stably in the fluid due to a lack of the surfactant component, and the oil content separates in the fluid and floats to the surface of the second cleaning fluid 2.

In the third embodiment, the second cleaning fluid 2 in which water-soluble oil is dissolved is purified utilizing this phenomenon. By microscopic air bubbles generated by the second microscopic air bubble generation device 23 being supplied to the second collecting tank 22, the surfactant component of the water-soluble oil is changed to metal soap, causing an oil content component to separate. Furthermore, the second cleaning fluid 2 is purified by an insoluble component floating on the surface being collected by a collecting device such as an oil skimmer (omitted from the drawing).

Figure 6:
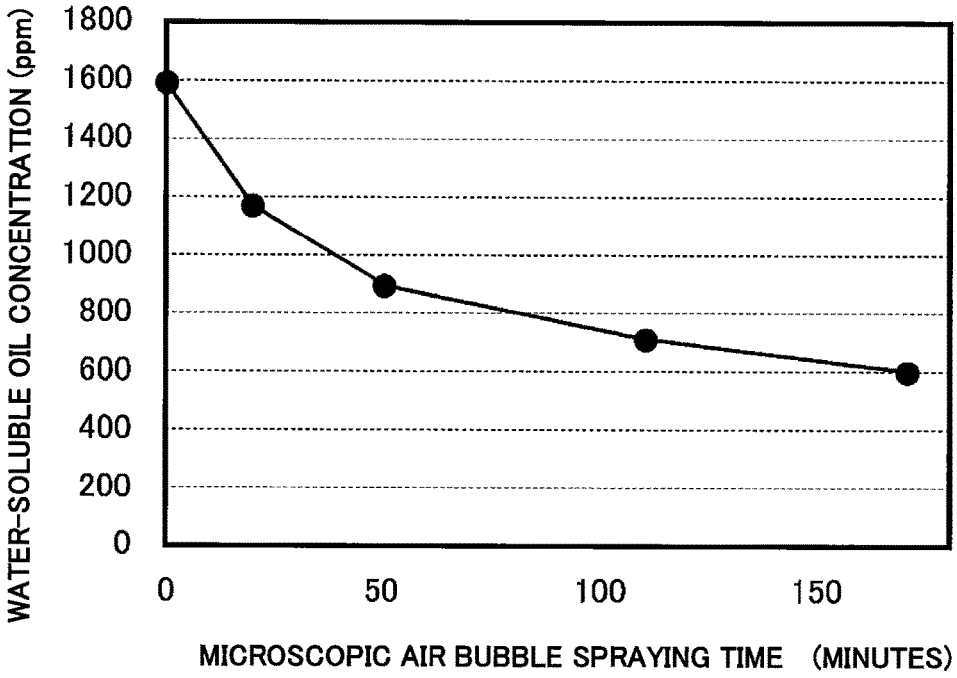
FIG. 6 is a diagram showing a change in concentration of a water-soluble oil when microscopic air bubbles are caused to act on the water-soluble oil dissolved in water.

FIG. 6 shows a change in concentration of a water-soluble oil when microscopic air bubbles are caused to act on the water-soluble oil dissolved in water. In FIG. 6, a vertical axis is the water-soluble oil concentration (ppm), and a horizontal axis is a microscopic air bubble spraying time (minutes). In this experiment, microscopic air bubbles are supplied to an aqueous solution including a water-soluble oil regulated to an initial concentration of 1,600 ppm, and a decrease in the water-soluble oil concentration can be confirmed. Microscopic air bubble generation conditions at the time are that a Venturi type microscopic air bubble generation device is used, the amount of water supplied is 7 liters per minute, and the amount of air supplied is 14 liters per minute.

As the second cleaning tank 20A includes the ultrasonic wave emitting device 21, a region in which microscopic air bubbles are supplied to the water-soluble oil needs to be a region differing from an ultrasonic wave irradiated region. This is because transmission of the ultrasonic wave is impeded by the existence of air bubbles, and the ultrasonic wave becomes unable to reach the cleaning target 3. In particular, a retention time in water increases in the case of microscopic air bubbles, and the effect thereof is noticeable.

In the third embodiment, in order to prevent microscopic air bubbles from affecting ultrasonic wave cleaning, purification of the second cleaning fluid 2 using microscopic air bubbles is carried out in the second collecting tank 22 that holds the second cleaning fluid 2 caused to overflow from the second cleaning tank 20A. As the purification of the second cleaning fluid 2 is not an existing purification whereby a precipitate is caused to float using air bubble adsorption, a discharge port 27 that sprays the second cleaning fluid 2 including microscopic air bubbles need not necessarily be installed in a bottom portion of the second collecting tank 22, but may also be installed in an intermediate position between the surface and the bottom portion.

Figure 7:
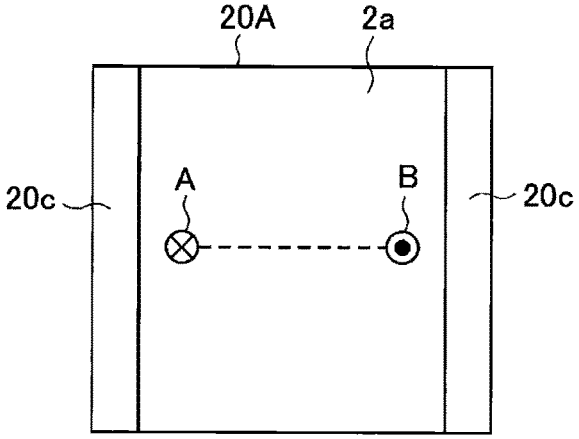
FIG. 7 is a top view showing the second cleaning tank in the cleaning device according to the third embodiment of the invention.
Figure 8:
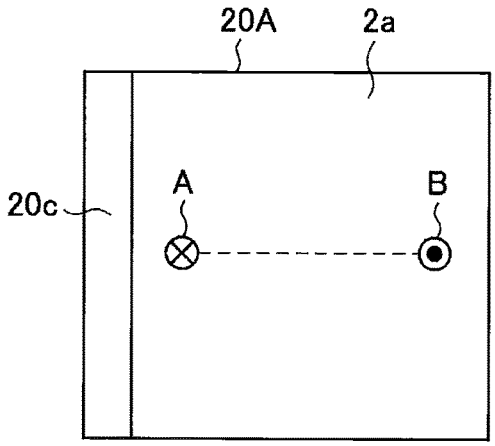
FIG. 8 is a top view showing another example of the second cleaning tank in the cleaning device according to the third embodiment of the invention.

FIG. 7 is a top view showing the second cleaning tank 20A shown in FIG. 5, wherein the second cleaning fluid 2 is caused to overflow from two opposing wall faces. Also, FIG. 8 is a top view showing another example of the second cleaning tank 20A in the cleaning device according to the third embodiment. As shown in FIG. 8, the second cleaning fluid 2 may be caused to overflow from one wall face. In addition to the examples shown in FIG. 7 and FIG. 8, the second cleaning fluid 2 may be caused to overflow from all wall faces of the second cleaning tank 20A.

In FIG. 7 and FIG. 8, A indicates a position in which the cleaning target 3 is introduced into the second cleaning fluid 2, and B indicates a position from which the cleaning target 3 is removed from the second cleaning fluid 2. The overflow from one wall face shown in FIG. 8 is advantageous in terms of reducing the installation space of the second cleaning tank 20A, while the overflow from two wall faces shown in FIG. 7 is advantageous in terms of the cleaning efficiency of the second cleaning fluid 2.

When causing the second cleaning fluid 2 to overflow from one wall face due to a restriction on installation space, a surface 2*a* of the second cleaning fluid 2 in the second cleaning tank 20A preferably flows in the direction of the cleaning target introduction position A from the cleaning target removal position B in order to prevent impurities from adhering again to the cleaning target 3. Consequently, the second cleaning fluid 2 is caused to overflow from a wall face near the cleaning target introduction position A, as shown in FIG. 8.

Also, in the third embodiment, the second cleaning fluid 2 caused to overflow from the second cleaning tank 20A is collected in the second collecting tank 22 via the second collecting groove 20*c*, but the second cleaning fluid 2 need not necessarily pass through the second collecting groove 20*c*. Also, overflowing is employed as a method whereby the second cleaning fluid 2 moves from the second cleaning tank 20A to the second collecting tank 22, but a movement method not being limited to this, another method may be employed.

According to the third embodiment, in addition to the same advantages as in the first embodiment and second embodiment, maintainability is further improved, and a high cleaning power can be stably secured for a long period, by a purifying mechanism being provided in the second cleaning tank 20A. The embodiments can be freely combined, and each embodiment can be modified or abbreviated as appropriate, without departing from the scope of the invention.

The invention claimed is:

1. A cleaning device, comprising:

a first cleaning tank that holds a first cleaning fluid;

a first microscopic air bubble generation device that generates microscopic air bubbles in the first cleaning fluid;

a first circulating pump that causes the first cleaning fluid to circulate and supplies the first cleaning fluid including microscopic air bubbles to the first cleaning tank;

a second cleaning tank that holds a second cleaning fluid;

an ultrasonic wave emitting device that irradiates an interior of the second cleaning tank with an ultrasonic wave;

a carrier device that holds a cleaning target, conveys the cleaning target to the first cleaning tank, and subsequently continues by conveying the cleaning target to the second cleaning tank;

a first collecting tank that holds the first cleaning fluid caused to overflow from a wall face of at least one portion of the first cleaning tank;

a first supply regulation unit that regulates an amount of the first cleaning fluid supplied from the first cleaning tank to the first microscopic air bubble generation device; and a second supply regulation unit that regulates an amount of the first cleaning fluid supplied from the first collecting tank to the first microscopic air bubble generation device, wherein water, to which an additive that prevents air bubble coalescence is added, is used as the first cleaning fluid, one of water, a water-based cleaning agent, an alkaline cleaning fluid, or a hydrophilic organic solvent is used as the second cleaning fluid, the first cleaning tank has a partitioning plate that divides a surface of the first cleaning fluid held in an interior of the first cleaning tank into two regions, those being a cleaning target introduction region into which the cleaning target is introduced and a cleaning target removal region from which the cleaning target is removed, the partitioning plate is installed leaving a gap with a bottom portion of the first cleaning tank through which the cleaning target can pass, the first circulating pump supplies the first cleaning fluid including microscopic air bubbles to the first cleaning tank, and the carrier device introduces the cleaning target from the cleaning target introduction region of the first cleaning tank, causes the cleaning target to pass below the partitioning plate, and removes the cleaning target from the cleaning target removal region.

2. The cleaning device according to claim 1, wherein the first circulating pump supplies the first cleaning fluid including microscopic air bubbles to a bottom portion of the cleaning target introduction region in the first cleaning tank.

3. The cleaning device according to claim 1, comprising a first collecting groove that collects the first cleaning fluid caused to overflow from a wall face of at least one portion of the first cleaning tank.

4. The cleaning device according to claim 1, wherein the first circulating pump supplies the first cleaning fluid held in the first cleaning tank and the first cleaning fluid held in the first collecting tank to the first cleaning tank via the first microscopic air bubble generation device.

5. The cleaning device according to claim 1, comprising:

a second collecting tank that holds the second cleaning fluid caused to overflow from a wall face of at least one portion of the second cleaning tank;

a second microscopic air bubble generation device that generates microscopic air bubbles in the second cleaning fluid; and a second circulating pump that causes the second cleaning fluid to circulate.

6. The cleaning device according to claim 5, comprising a second collecting groove that collects the second cleaning fluid caused to overflow from a wall face of at least one portion of the second cleaning tank.

7. The cleaning device according to claim 5, wherein the second circulating pump supplies the second cleaning fluid held in the second collecting tank to the second cleaning tank, and returns the second cleaning fluid held in the second collecting tank to the second collecting tank via the second microscopic air bubble generation device.

8. The cleaning device according to claim 1, wherein a rust-preventive agent is added to either or both of the first cleaning fluid and second cleaning fluid.

* * * * *